United States Patent [19]

Rauschenberger

[11] 4,354,710

[45] Oct. 19, 1982

[54] HINGE FOR A CHAISE AND THE LIKE

[76] Inventor: Jörg Rauschenberger, Gartenstr. 8, 7144 Asperg, Fed. Rep. of Germany

[21] Appl. No.: 162,735

[22] Filed: Jun. 25, 1980

[30] Foreign Application Priority Data

Jun. 25, 1979 [DE] Fed. Rep. of Germany ..... 2925558

[51] Int. Cl.[3] ..... A47C 1/025; G05G 5/06

[52] U.S. Cl. ..... 297/356; 16/343; 74/540; 74/577 M; 297/366; 403/95

[58] Field of Search ..... 297/356, 366–370, 297/371, 354, 355, 379, 16, 19; 16/146, 145, 139; 74/527, 540, 577 R, 577 M; 403/62, 93, 95, 96, 103, 105–107

[56] References Cited

U.S. PATENT DOCUMENTS 3,304,107 2/1967 Bahmuller ..... 403/93
3,352,580 11/1967 Kurz et al. ..... 297/366 X
3,484,831 12/1969 Higuchi ..... 297/356 X

FOREIGN PATENT DOCUMENTS 1294747 5/1969 Fed. Rep. of Germany ..... 403/95
1333907 6/1963 France ..... 403/103
677374 11/1964 Italy ..... 297/355

*Primary Examiner*—William E. Lyddane
*Attorney, Agent, or Firm*—Michael J. Striker

[57] ABSTRACT

A hinge for a chaise and the like has a first hinge element having a segment portion with a plurality of first arresting formations, a second hinge element provided with an arresting member pivotally mounted on the same and having control faces and a plurality of second arresting formations arranged to abut against the first arresting formations, and control projections engageable with the control faces of the arresting member so as to guide the latter in connection with the first hinge element having the segment portion.

41 Claims, 18 Drawing Figures

Fig. 11
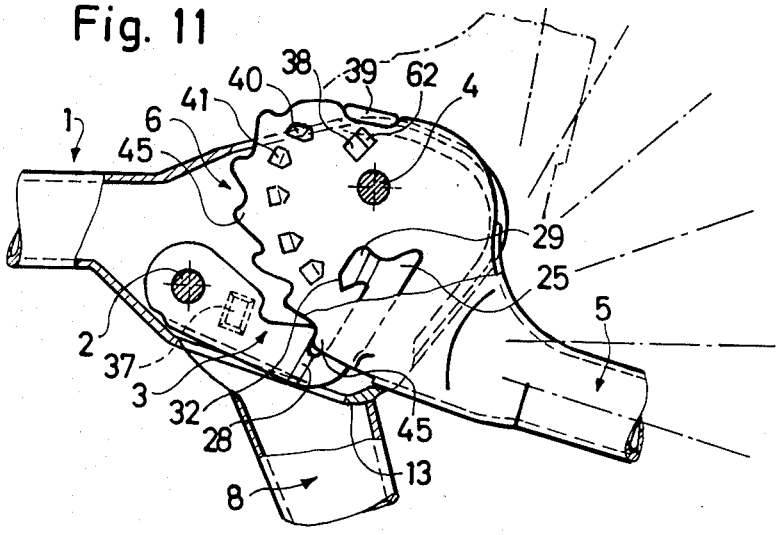
Fig. 12
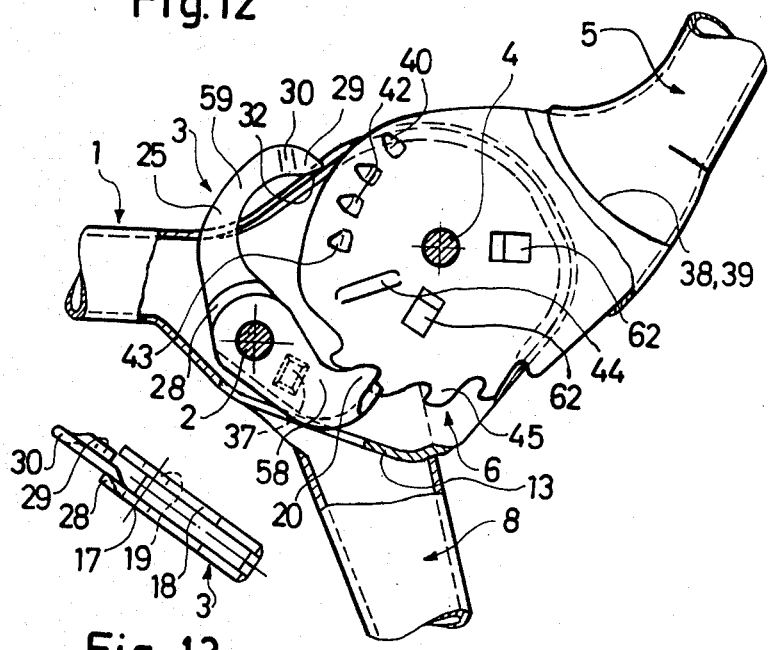
Fig. 13

Fig. 14
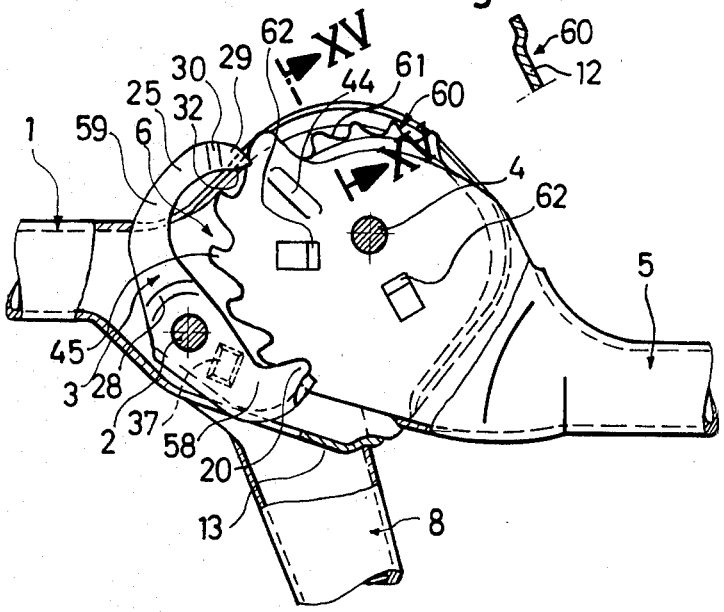
Fig. 15
Fig. 16
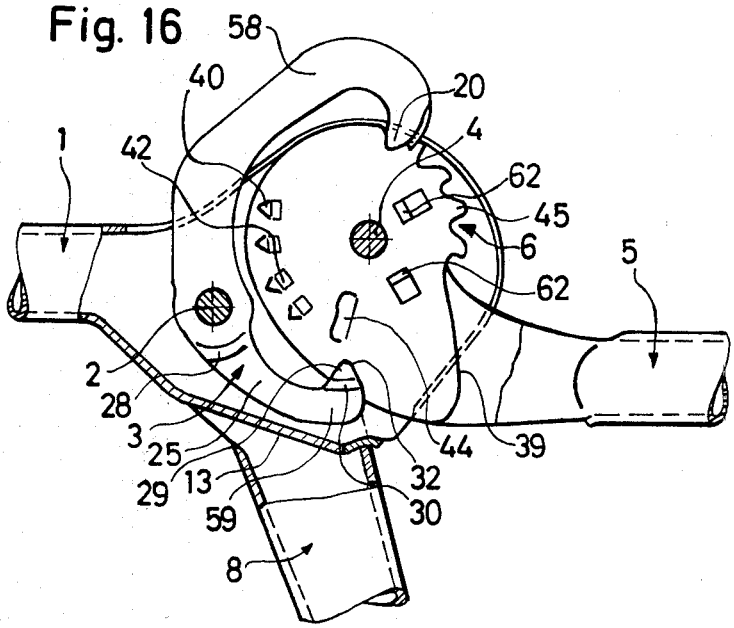

HINGE FOR A CHAISE AND THE LIKE

BACKGROUND OF THE INVENTION

The present invention relates to a hinge for a chaise and the like.

Hinges of the above-mentioned general type are known in the art. A known hinge has a first hinge element provided with an arresting segment having a plurality of saw-tooth-shaped formations, and a second hinge element provided with a pivotally mounted arresting member which has control faces and second arresting formations arranged to abut against the arresting formations of the segment of the first hinge element.

One of such hinges is disclosed, for example, in the German Pat. No. 1,123,443. The hinge disclosed in this patent has the arresting member which is formed as a two-arm lever. A leaf spring engages one arm of the arresting member so as to press the arresting formations of the other arm into the tooth gaps of the arresting segment of the first hinge element. For controlling the position of the arresting member, a special pulling disc is provided which allows the engagement of the arresting formations in one position and prevents the same in another position. This hinge is utilized in articles which are manufactured in mass production in great number, so that the number, construction, and mounting of the individual parts has decisive importance for the price and dimensions of the articles.

Another hinge is disclosed in the German Pat. No. 1,253,961 which is so designed that the utilization of a spring is no longer needed. It is provided with a special control lever which is frictionally connected with one hinge element and, in dependence upon the direction of pivoting of this hinge element, retains the engagement of the arresting member with the arresting segment or interrupts the same. The known hinges possess some disadvantages in that they are not always satisfactory with respect to the simplicity of their construction and reliability against failures.

SUMMARY OF THE INVENTION

Accordingly, it is an object of the present invention to provide a hinge for chaises and the like, which avoids the disadvantages of the prior art.

More particularly, it is an object of the present invention to provide a hinge for a chaise and the like, which has a simple construction and is reliable in operation.

In keeping with these objects, and with others which will become apparent hereinafter, one feature of the present invention resides, briefly stated, in a hinge which has a first hinge element having a segment portion with a plurality of first arresting formations, a second hinge element provided with an arresting member pivotally mounted on the same and having control faces and at least one second arresting formation arranged to abut against the first arresting formation, wherein means for guiding the arresting member in connection with the first hinge element is provided, the guiding means including control projections engageable with the control faces of the arresting member.

When the hinge is designed in accordance with the present invention, a special spring or a special control lever can be dispensed with, which leads not only to saving of some parts but also to a higher operational reliability which is not affected by wear of some individual parts.

The control projections may be provided directly on the first hinge element; however, the control faces may also be formed by flat flanks of the arresting formations of the first hinge element and the arresting member. The arresting formations of the first hinge element are coordinated with the control projections which are formed in one disc of the first hinge element. The control projections form wedges or teeth whose faces serve as control faces.

In order to guide the arresting member toward its one end position, second control projections are provided. They guide the arresting member when the hinge elements move towards their folded position from a vertical over an angle of substantially 45°. Finally, the first hinge element is provided with a further control projection which is so arranged that when the first hinge element moves in opening direction over an angle of substantially 180°, the second arresting formation of the arresting member is guided toward the first hinge element so that the second arresting formation of the arresting member forms a support for the first arresting formation of the first hinge element.

An especially compact construction is attained when the second control projections and the further control projection are arranged diametrically opposite relative to one another and at opposite sides of a pivot axis of the first hinge element, and the first-mentioned control projections are arranged circumferentially between the second control projections and the further projection. The radial distance between the control projections and the pivot axis of the first hinge element may decrease, starting from the further control projection.

The arresting member may have a U-shaped cross section, and the control faces of the arresting member may be arranged so that their projections onto the pivot axis of the arresting member are offset relative to one another. At least one leg of the arresting member forms an extension which is bent and forms one control face. The extension may be bent twice by a distance corresponding to the thickness of the material of the arresting member. The extension may have a first bent section arranged adjacent to the second arresting formation, and a second bent section arranged adjacent to the one control face. The second bent section may form a tongue engageable with the first control projections of the first hinge element. The first control projections and the tongue may be wedge-shaped so as to engage with one another over wedge-shaped faces.

In accordance with one embodiment of the invention, the arresting member is formed as a one-arm lever having one end at which the openings are provided, and another end in which the extension is formed, wherein the second arresting formation is arranged between the openings and the extension. The extension extends substantially normal to the direction of elongation of the arresting member, and the first bent section has an outer end face which forms one control face engaged with the further control projection. In accordance with another embodiment of the invention, the arresting member is formed as a two-arm lever. In this case, the second arresting formation is provided at the end of one arm and the above-mentioned one control face is provided at the end of the other arm of the arresting member.

In accordance with a further feature of the invention, the first arresting formation of the hinge element and the second arresting formation of the arresting member are so arranged in loaded condition relative to the pivot axes of the arresting member and the first hinge element, that a force component of the tips of the second arresting formation of the arresting member leads toward the roots of the first arresting formations of the first hinge element. The first and second arresting formations may have steep flanks which are arranged so that when the second arresting formation of the arresting member engages in the first arresting formation of the first hinge element, the arresting formations support on each other. In this case, a deep interengagement is provided, so that the entire tooth cross-section takes up the load, and moreover, the engagement of the next control projection in the arresting member is prepared.

The hinge may be so designed that the arresting member is subjected to pressure, when the first arresting formations of the arresting segment of the first hinge elements are supported. In this case, the arresting member is braked by friction during its pivotal movement, and the force of gravity cannot withdraw its arresting formations from the arresting formations of the arresting segment of the first hinge element.

In accordance with another embodiment, the arresting member and the arresting segment are so arranged that in engaged condition of the arresting formations with loading of the first hinge element, the arresting member is subjected to pulling action. In this case, the arresting formations of the arresting member are arranged above the arresting formations of the arresting segment, so that they are introduced into the arresting formations of the latter under the action of the force of gravity, and braking during the pivotal movement of the arresting member is not necessary.

The novel features of which are considered as characteristic for the invention are set forth in particular in the appended claims. The invention itself, however, both as to its construction and its method of operation, together with additional objects and advantages therefor, will be best understood from the following description of specific embodiments when read in connection with the accompanying drawings.

BRIEF DESCRIPTION OF THE DRAWINGS

FIG. 11 is a view showing a hinge for chaise and the like, in accordance with a second embodiment of the present invention;

FIG. 12 is a view showing a hinge for a chaise and the like, in accordance with a third embodiment of the present invention;

FIG. 13 is a front view of the arresting member of the hinge of FIG. 12;

FIG. 14 is a view showing a hinge for a chaise and the like, in accordance with a fourth embodiment of the present invention;

FIG. 15 is a view along the line XV—XV in FIG. 14;

FIG. 16 is a view showing a hinge in accordance with a fifth embodiment of the present invention;

DESCRIPTION OF PREFERRED EMBODIMENTS

Figure 1:
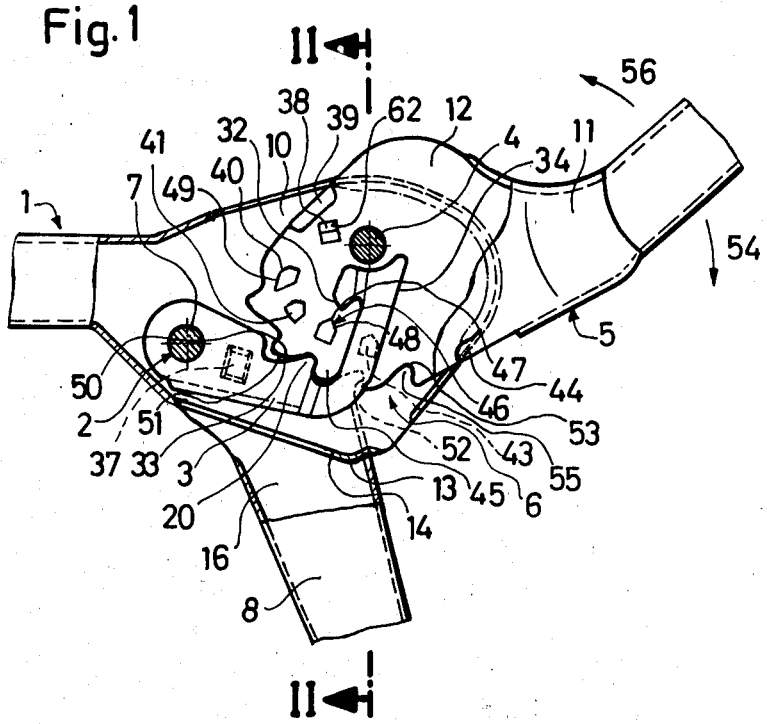
FIG. 1 is a view showing a hinge for a chaise and the like in accordance with one embodiment of the present invention, wherein the hinge is partially sectioned and shown in its arresting position.

A hinge for a chaise in accordance with the present invention has a hinge part 1 with a pivot axle 2 for an arresting member 3, and a pivot axle 4 for a hinge part 5 provided with an arresting segment 6.

Figure 2:
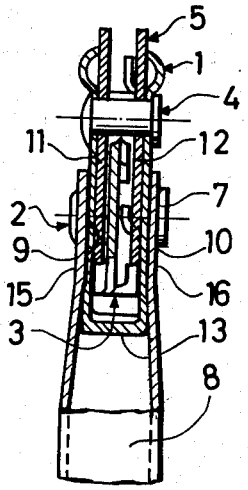
FIG. 2 is a view showing a section taken along the line II—II in FIG. 1.

A foot member 8 is mounted on the pivot axle 2 and has a fork-shaped end portion. The hinge parts 1 and 5 also have fork-shaped end portions. The end portion of the hinge part 1 includes two discs 9 and 10, whereas the end portion of the hinge part 5 includes two discs 11 and 12. As can be seen from FIG. 2, the discs 11 and 12 of the hinge part 5 are located between the discs 9 and 10 of the hinge part 1.

The discs 9 and 10 of the hinge part 1 are connected with one another by a bottom 13 which is provided with a through-going opening 14. The arresting member 3 partially extends through the opening 14 in its end position, as can be seen from FIG. 7. The end portion of the foot member 8 has discs 15 and 16 which surround the discs 9 and 10 of the hinge part 1. They are supported on the axle 7.

Figure 3:
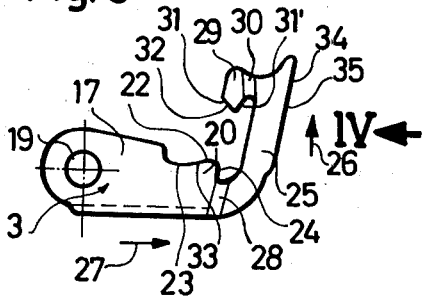
FIG. 3 is a side view showing an arresting member of the hinge of FIG. 1.
Figure 4:
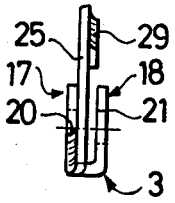
FIG. 4 is a view of the arresting member in direction of the arrow IV in FIG. 3.

The arresting member 3 which is received between the discs 9 and 10 of the hinge part 1 has a construction which is shown in FIG. 1, and particularly can be seen in FIGS. 3 and 4. It has a substantially U-shaped cross-section with arms 17 and 18. The latter have openings 19 for receiving the axle 7. Arresting teeth 20 and 21 are formed at the other end of the arms 17 and 18. The arresting teeth 20 and 21 are saw-tooth-shaped and extend from a tooth tip 22 over a flat flank 23 at one side and over a steep flank 24 at the other side.

The arm 27 extends over the arresting tooth 20 outwardly and forms a projection 25. The latter extends in direction of the arrow 26 substantially normal to the longitudinal direction of the arrow 27 of the arresting member 3. It has a first bent portion 28 which is offset towards the other arm 18 substantially by a distance corresponding to the thickness of the material. The projection 25 is provided at its free end with a tongue 29 which extends toward the opening 19 and has a second bent portion 30 which projects from the arm 13 by a distance corresponding to the thickness of the material. The tongue 29 is wedge-shaped and has wedge faces 31 and 31' which are formed as control faces. The flat flank 23 and an outer end face 35 of the projection 25 form further control faces 33 and 34.

Figure 5:
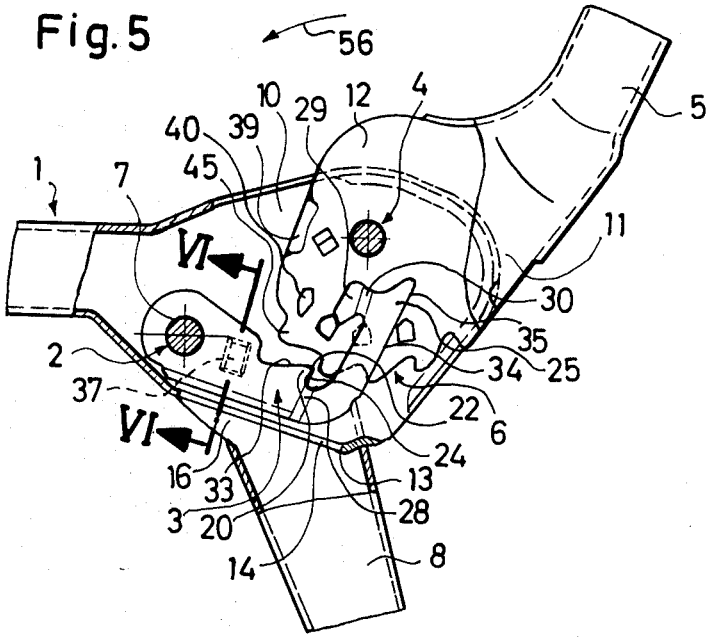
FIG. 5 is a view showing the hinge of FIG. 1 in which it is prepared for engagement.
Figure 6:
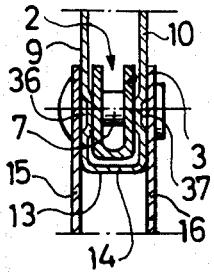
FIG. 6 is a view showing a section along the line VI—VI in FIG. 5.

The discs 9 and 10 of the hinge part 1 are provided in accordance with the embodiment of FIG. 1, with projections 36 and 37, as can be seen particularly in FIGS. 5 and 6. The discs 17 and 18 of the arresting member 3 can be easily introduced between the projections 36 and 37, so that the pivotal movement of the arresting member 3 is accompanied by a certain friction.

Figure 8:
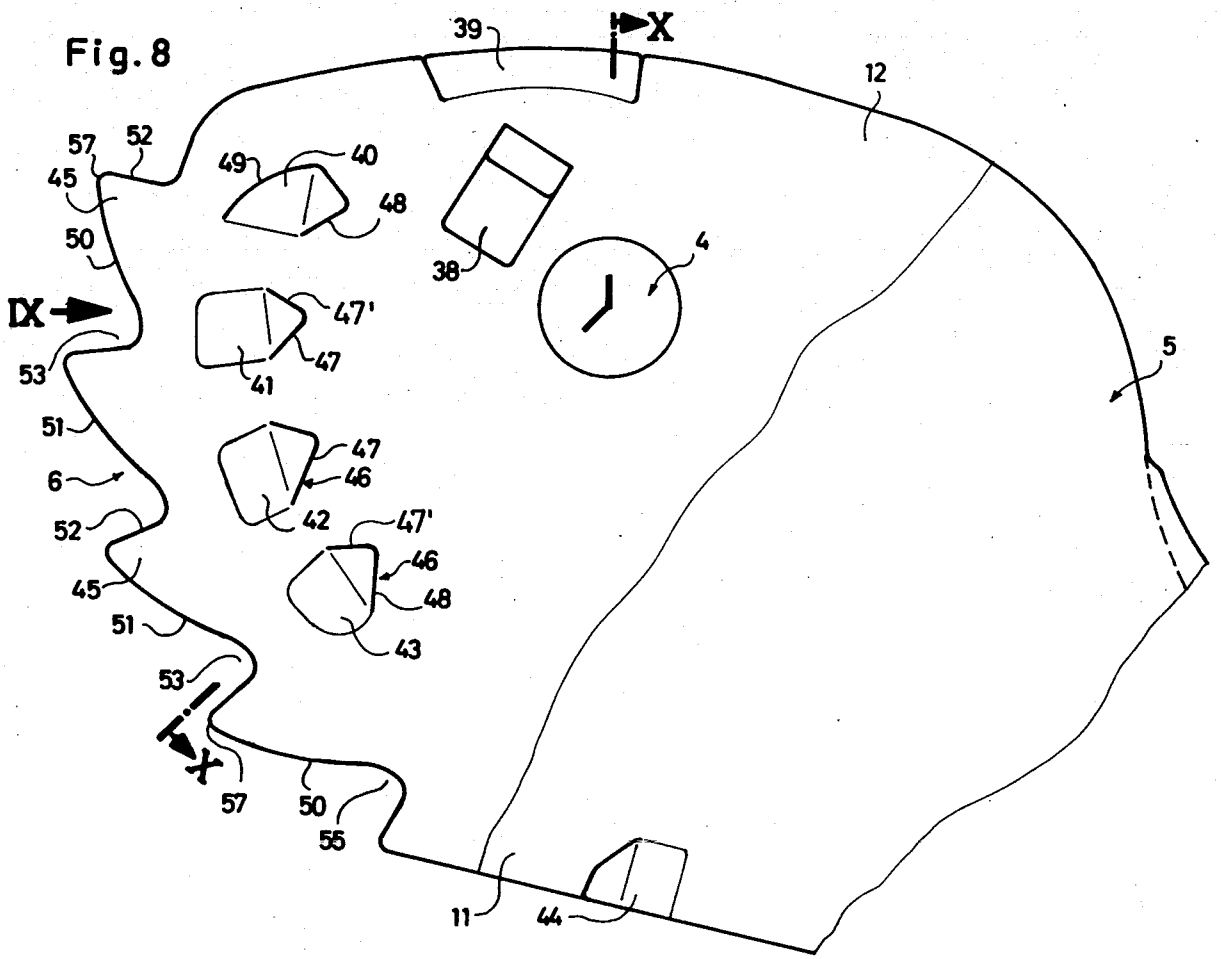
FIG. 8 is an enlarged side view of one hinge element with a toothed segment of the hinge of FIG. 1.
Figure 9:
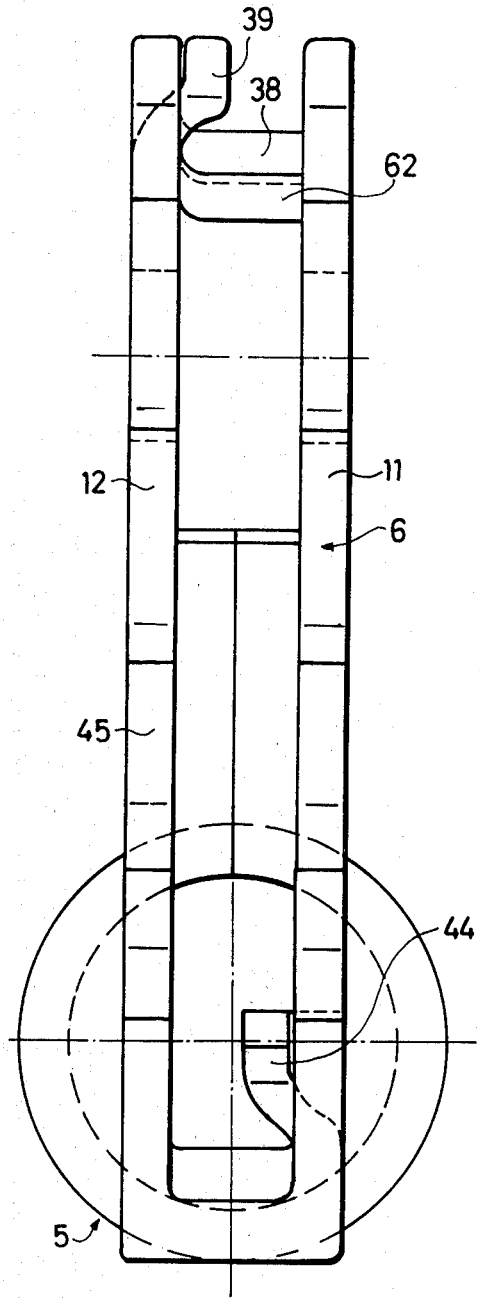
FIG. 9 is a view in the direction of the arrow IX in FIG. 8, wherein a part of control projections is removed for the sake of clarity.
Figure 10:
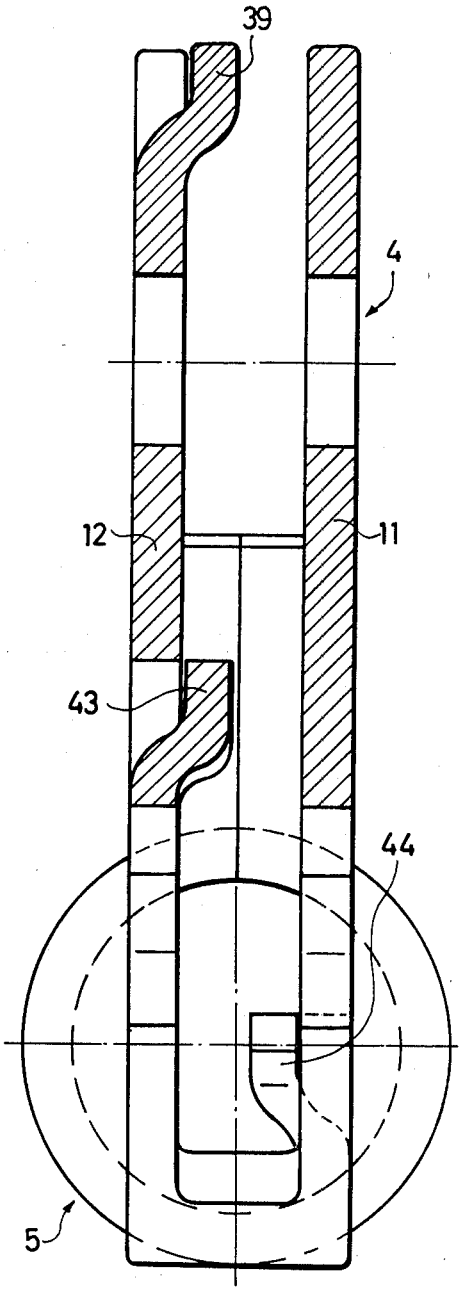
FIG. 10 is a view showing a section along the line X—X in FIG. 8.

The hinge part 5 has control projections 38, 39, 40, 41, 42, 43 and 45 which, up to the control projection 44, are stamped out in the disc 12, as can be seen particularly from FIGS. 8–10. The control projection 44 is formed in the disc 11. Thereby all control projections 38–44 are bent toward the interior between the discs 11 and 12 by a distance substantially corresponding to the thickness of material.

The control projections 40–43 are coordinated with their respective arresting teeth 45 of the arresting segment 6. They have the shape of wedges 46 whose teeth are directed, as shown in FIG. 1, toward the pivot axle 4. Wedgeshaped faces 47 and 47' form control faces 48 which cooperate with control faces 32 of the tongue 29, formed by wedgeshaped faces 31 and 31'.

The control projections 38 and 39 are located substantially diametrically opposite to the control projection 44, with respect to the pivot axle 4. The distance of the control projections from the pivot axle 4 decreases, starting from the control projection 44 in clockwise direction as seen particularly from the control projection 39. The control projection 40 is provided with a further control face 49 which cooperates with the tongue 29. The flat flanks 50 of the arresting teeth 45 form control faces 51 which cooperate with the control faces 33 of the arresting teeth 20 of the arresting member 3.

The arresting teeth 20, 21 and 45 are so arranged relative to the pivot axles 2 and 4 that when they abut against one another and the hinge part 5 is loaded, they slide over one another until the teeth tips 22 of the arresting teeth 20 and 21 extend substantially to a tooth root 53 of the arresting teeth 45. This movement is facilitated by the fact that the steep flanks 24 and 53 of the arresting teeth 20, 21 and 45 have respective inclination.

The discs 11 and 12 of the hinge part 5 are fixed in their relative location by one or several spacers 62. In the embodiments of FIGS. 1 and 11, the control projections 38 are formed as raised tongues which simultaneously form the spacer 62.

Figure 7:
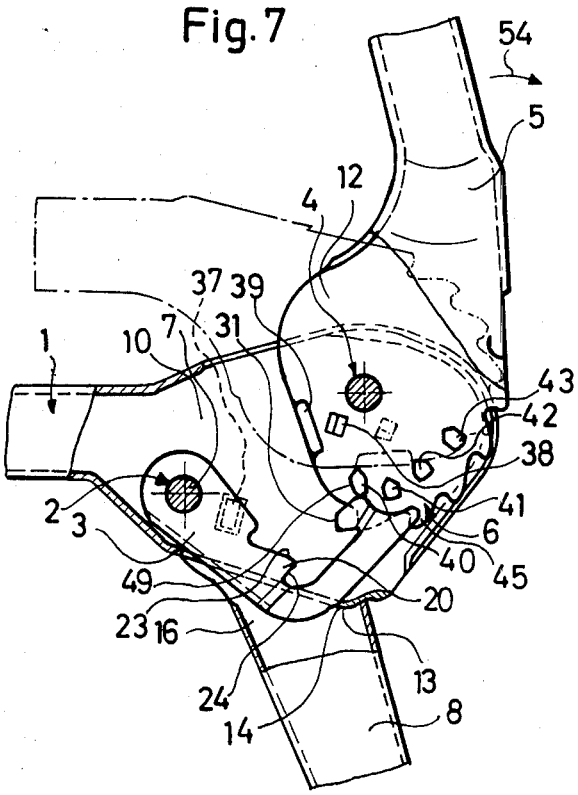
FIG. 7 is a view showing the hinge of FIG. 1 in a position in which the arresting member assumes its end position and the hinge elements are in their completely open positions.

The hinge in accordance with the first embodiment of the invention shown in FIGS. 1–10, operates in the following manner:

The hinge is first folded, that is, the hinge part 5 is turned to the hinge part 1, as shown in dash dot line in FIG. 7. When the hinge part 5 moves in opening direction identified by the arrow 54, the arresting member 3 is turned to its end position by the control face 49 of the control projection 40 and the further control projections 41–43. In the end position, it partially extends through the opening 14 in the bottom 13 of the hinge part 1. When the opening angle corresponds to substantially 180°, the control projection 44 comes to abutment against the control face 34 formed by the outer end face 35 of the arresting member 3. As a result of this, during further turning of the hinge part 5 to the opening position in accordance with the arrow 54, the arresting member 3 is lifted to the pivot axle 4, until finally the arresting teeth 20 of the arresting member 3 are completely inserted into the teeth gaps 55 of the first arresting tooth of the arresting segment 6 and their steep flanks 24 form a support. Thus, the hinge attains its maximum opening angle.

During movement in the folding direction in accordance with the arrow 56, the hinge part 5 is shifted from one arresting tooth to the other arresting teeth. During the movement of the hinge part 5 in the folding direction, identified by the arrow 56, first the control faces 51 of the arresting teeth 45 act upon the control faces 33 of the arresting teeth 20 and so that the arresting member 3 moves downwardly toward the bottom 13 of the hinge part 1. Substantially at the moment when the tooth tips 57 of the arresting teeth 45 run over the tooth tips 22 of the arresting teeth 20, the control faces 48 of the first control projection 43 abut against the control faces 33 of the tongue 29, so that during further movement of the hinge part 5 to the folded position, identified by the arrow 55, the arresting member 3 moves further relative to the pivot axle 4.

As soon as the tip of the wedge 46 is attained or overlapped, the hinge part 5 moves in the opening direction identified by the arrow 54, so that the steep flanks 52 of the arresting teeth 45 extend to the steep flanks 24 of the arresting teeth 20 of the arresting member 3 and slide downwardly over the same, until the tooth tips 57 extend to the bottom of the arresting teeth 20. Thereby, the new arresting position of the hinge part 5 is attained. In this manner, the next arresting position can be attained from tooth to tooth. FIG. 5 shows the position in which the arresting member 3 over the control faces 48 of the control projection 41 is lifted during movement of the hinge part 5 in the folding direction, in order to be prepared for the arresting of the respective arresting teeth.

As to the arresting position of the last tooth, during further turning of the hinge part 5 in the folding direction identified by the arrow 55, the arresting member 3 moves downwardly to the bottom 13 over the control projections 38 engaged with the tongue 29 and then over the control projection 39. Thus, finally the completely folded position identified by the dash dot line in FIG. 7 can be attained.

The hinge in accordance with the embodiment in FIGS. 11–18 has identical parts which are identified by identical reference numerals. The operation of the hinge is substantially identical to the operation of the hinge described above, so that only some distinctions in the construction of the hinge will be described hereinbelow.

The hinge of FIG. 11 has a construction which substantially corresponds to the construction of the hinge of FIG. 1. However, the arresting segment 6 of the hinge part 5 is provided with an additional pair of arresting teeth 45, so that the hinge part 5 can be shifted horizontally. The individual positions of the hinge part 5 in the arresting condition are shown in dash dot lines. This "negative shifting" is possible for all four described hinge constructions, when the toothed segment 6 of the hinge part 5 is respectively shifted.

In the embodiment of FIGS. 12–17, the arresting member 3 has two arms. An end portion of one arm 58 has the arresting teeth 20 and 21, whereas an end portion of the other arm 59 has the tongue 29 with the control faces 32.

In the hinge of FIGS. 12–14, the arresting teeth 20 and 21 are located below the arresting teeth 45 of the hinge part 5. In order to prevent falling off because of the gravity force, further projections 36 and 37 are provided against which the arresting member 3 abuts with friction action, so that it is braked during its turning movement. The arm 59 forms the projection 25, it makes longer the arm 17 of the U-shaped arresting member 3 and is provided with the bent portions 28 and 30. The control projections 38–43 are again stamped out in the disc 12 of the hinge part 5. The hinge of FIG. 14 differs from the hinge of FIG. 12 in that the control projections 40–43 are replaced by teeth 60 which are offset by the thickness of material and stamped out as shown in FIG. 14. Teeth flanks 61 correspond here to the wedge faces 47 of the control projections 40–43. Instead of the projection 37 for braking the arresting member 3, a corrugation can be stamped out around the axle 7 in the arresting member 3 or in the discs 9 and 10. These parts may be so firmly riveted that they become tight.

Figure 17:
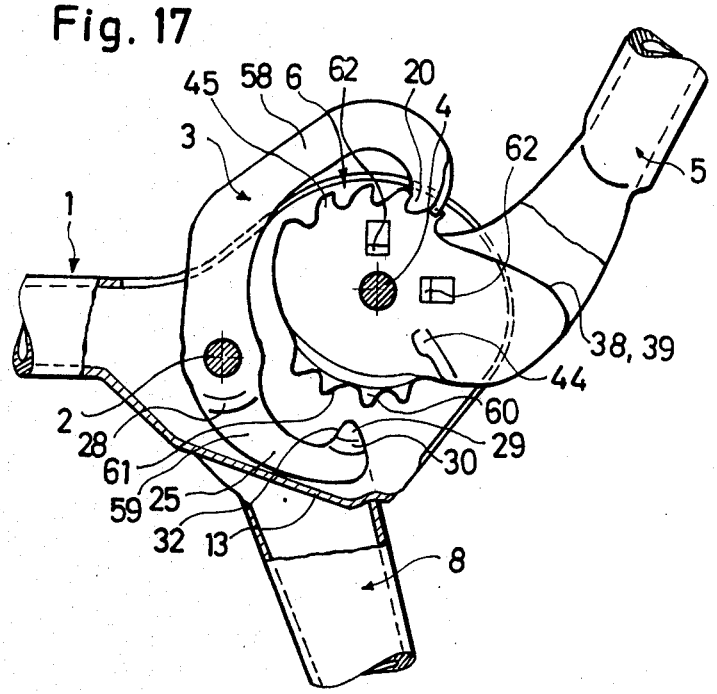
FIG. 17 is a view showing a hinge in accordance with a sixth embodiment of the present invention.

In the embodiment of FIGS. 16 and 17, the arresting teeth 20 and 21 of the arresting member 3 and the arresting segment 6 of the hinge part 5 extend upwardly, so that the arresting teeth 20 and 21 enter the teeth gaps of the arresting teeth 45 under the action of gravity and are not withdrawn from the same freely. In this case, the arm 59 with the tongue 29 are located below the bearing support 4. When the hinge part 5 is loaded and the arresting teeth are engaged, the arresting teeth 20 and 21 of the arresting member 3 are subjected to pulling action. In the embodiment of FIG. 16, the control projections 40–43 are again provided, whereas in the embodiment of FIG. 17 the teeth 60 are provided which cooperate with the tongue 29 of the arresting member 3. In this case, a brake for the arresting member 3 is saved, and the projections 36 and 37 can be dispensed with.

Figure 18:
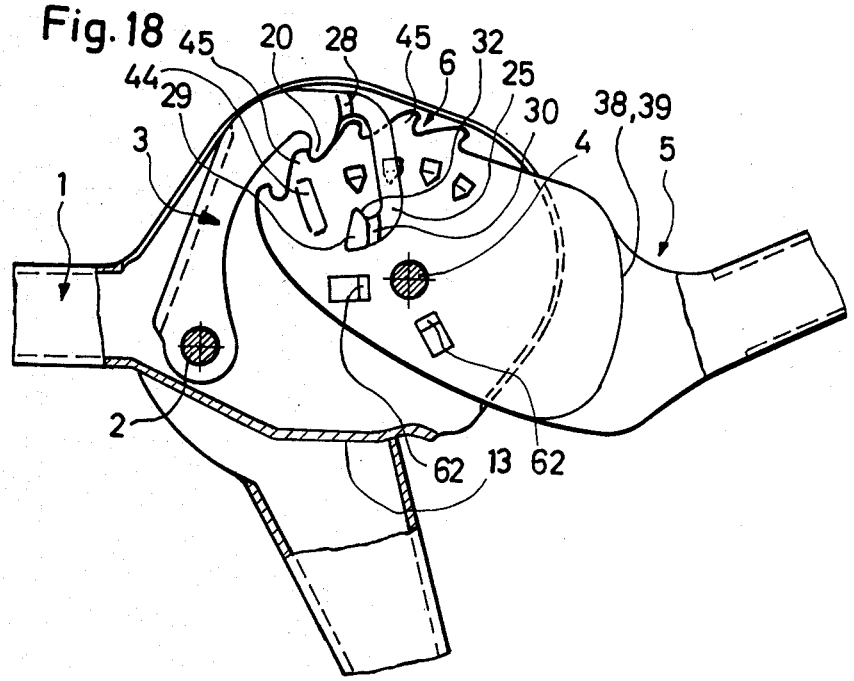
FIG. 18 is a view showing a hinge in accordance with a seventh embodiment of the present invention.

In the embodiment of FIG. 18, the arresting teeth 20 and 21 are again located above the arresting teeth 45 of the arresting segment 6. Because of the special construction of the arresting member 3, the control projections 40–43, similarly to the embodiment of FIG. 1, are located in this case at the same side of the discs 11 and 12 as the arresting teeth 45, relative to the pivot axle 4.

It will be understood that each of the elements described above, or two or more together, may also find a useful application in other types of constructions differing from the types described above.

While the invention has been illustrated and described as embodied in a hinge for a chaise, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without citing features that, from the standpoint of prior art, fairly constitute essential characteristics of the generic or specific aspects of this invention.

What is claimed as new and desired to be protected by Letters Patent is set forth in the appended claims:

1. A hinge for a chaise and the like, comprising a first hinge element having a segment portion with a plurality of first arresting formations; a second hinge element provided with an arresting member pivotally mounted on the same and pivotable inwardly to its arresting position, said arresting member having control faces and at least one second arresting formation arranged to abut against said first arresting formations; and means for guiding said arresting member in connection with said first hinge element having said segment portion, said guiding means including control projections arranged so as to engage with said control faces of said arresting member, said control projections being associated with individual ones of said first arresting formations of said segment, so that said arresting member is guided during its inward pivoting to its arresting position.

2. A hinge as defined in claim 1, wherein said first arresting formations of said segment portion of said first hinge element are saw-tooth-shaped.

3. A hinge as defined in claim 1, wherein said control projections are provided directly on said first hinge element.

4. A hinge as defined in claim 1, wherein said control projections include first control projections which are coordinated with said first arresting formations of said first hinge element and project from the same.

5. A hinge as defined in claim 4, wherein said first control projections are wedge-shaped and have wedge faces formed as control faces.

6. A hinge as defined in claim 4, wherein said first control projections are tooth-shaped and have tooth flanks formed as control faces.

7. A hinge as defined in claim 4, wherein said arresting member is U-shaped and has two legs each provided with an opening for receiving an axle defining a pivot axis of said arresting member, each of said legs having an end portion forming one such second arresting formation.

8. A hinge as defined in claim 7, wherein one of said legs of said arresting member has an extension which is bent and forms said control faces.

9. A hinge as defined in claim 8, wherein said arresting member has a predetermined thickness, said extension being twice bent and offset relative to the remainder portion of said arresting member by a distance corresponding to said thickness.

10. A hinge as defined in claim 9, wherein said first hinge element has a pivot point, said extension of said one leg of said arresting member having a free end portion which extends toward said pivot point of said first hinge element and has one of said control faces arranged for engaging with said first control projections so as to prepare engagement of said first arresting formations of said segment of said first hinge element with said second arresting formation of said arresting member.

11. A hinge as defined in claim 10, wherein said extension of said one leg of said arresting member has a first bent section arranged adjacent to said second arresting formation, and a second bent section arranged adjacent to said one control face.

12. A hinge as defined in claim 11, wherein said second bent section forms a tongue engageable with said first control projections.

13. A hinge as defined in claim 12, wherein said first control projections are wedge-shaped, said tongue having a wedge-shaped face engageable with said wedge-shaped first control projections.

14. A hinge as defined in claim 12, wherein said control projections include second control projections arranged to guide said arresting member in its one end position, said second control projections cooperating with said tongue of said extension of said one leg of said arresting member.

15. A hinge as defined in claim 10, wherein said arresting member is formed as a one-arm lever having two spaced ends, said openings being formed at one of said ends, said extension being formed at the other of said ends, and said second arresting formation being formed between said openings and said extension.

16. A hinge as defined in claim 15, wherein said second arresting formation being arranged closer to said extension than to said openings.

17. A hinge as defined in claim 15, wherein said arresting member is elongated in a first direction, said extension extending in a second direction which is substantially normal to said first direction, said first bent section having an outer end face forming the other of said control faces of said arresting member.

18. A hinge as defined in claim 17, wherein said control projections include a further control projection which protrudes from said first hinge element and are arranged for preparing engagement in one end position of said arresting member, said further control projection cooperating with said outer end face of said first bent section of said extension of said arresting member.

19. A hinge as defined in claim 10, wherein said arresting member is formed as a two-arm lever each having an end, said second arresting formation being arranged at the end of one of said arms, whereas said one control face is arranged at the end of the other of said arms.

20. A hinge as defined in claim 1, wherein said first hinge element has a pivot axis and two parallel plate-shaped discs in the region of the latter, said control projections including control projections which are formed in one of said discs and extend in direction toward the other of said discs.

21. A hinge as defined in claim 20, wherein said control projections include at least one second control projection protruding laterally from one of said discs of said first hinge element and guiding said arresting member toward its one end position, said second control projection extending between and forming a spacer for said discs.

22. A hinge as defined in claim 1, wherein said control projections include second control projections protruding laterally from said first hinge element and guiding said arresting member toward its one end position.

23. A hinge as defined in claim 22, wherein said second control projections are arranged to guide said arresting member when said first hinge element moves toward said second hinge element to a folded position from a vertical over an angle of at least 45°.

24. A hinge as defined in claim 1, wherein said first hinge element has a pivot axis and two parallel plate-shaped discs in the region of the latter, said control projections having first control projections arranged to prepare said first arresting formations and said second arresting formations for engagement and second control projections arranged to guide said arresting member to its one end position, said first and second control projections being formed in one of said discs of said first hinge element.

25. A hinge as defined in claim 24, wherein said first and second control projections are stamped out in said one disc of said first hinge element.

26. A hinge as defined in claim 24, wherein said control projections include a further control projection which protrudes from said first hinge element and is so arranged that when said first hinge element moves in opening direction over angle of substantially 180°, said second arresting member is so guided toward said first hinge element that said second arresting formation of said arresting member forms a support for said first arresting formations of said first hinge element.

27. A hinge as defined in claim 26, wherein said further control projection is arranged for preparing engagement in one end position of said arresting member and extends from the other of said discs toward said one disc wherein said first and second control projections are formed.

28. A hinge as defined in claim 27, wherein said further control projection is bent out in said other disc.

29. A hinge as defined in claim 26, wherein said second control projections and said further control projection are arranged at opposite sides of said pivot axis of said first hinge element and substantially diametrically opposite relative to one another, said first control projections being arranged circumferentially between said second control projections and said further projection.

30. A hinge as defined in claim 29, wherein the radial distance between said control projections and said pivot axis of said first hinge element decreases, starting from said further control projection.

31. A hinge as defined in claim 1, wherein said arresting formations of said arresting member and said first hinge element have flat flanks forming additional control faces.

32. A hinge as defined in claim 31, wherein said arresting member has a pivot axis, said control faces of said arresting member being arranged so that their projections onto said pivot axis of said arresting member are offset relative to one another.

33. A hinge as defined in claim 1, wherein said first hinge element has a pivot axis and said arresting member also has a pivot axis, said arresting formations having tips and roots, said first arresting formations of said first hinge element and said second arresting formation of said arresting member being arranged in loaded condition relative to said pivot axes so that a force component of the tips of said second arresting formation of said arresting member lead toward the roots of said first arresting formations of said first hinge element.

34. A hinge as defined in claim 33, wherein said first and second arresting formations have steep flanks which are arranged so that when said second arresting formation of said arresting member engages in said first arresting formations of said first hinge element, said arresting formations support on each other.

35. A hinge as defined in claim 1; and further comprising means for frictionally braking said arresting member when the latter pivots in condition of loading by said first arresting formations of said segment of said first hinge element.

36. A hinge as defined in claim 1, wherein said second hinge element supports said arresting member and has two parallel plate-shaped discs with end portions connected by a bottom part.

37. A hinge as defined in claim 36; and further comprising means for braking said arresting member when the latter pivots, said braking means including inner projections extending inwardly of said discs and abutting against said arresting member with friction action.

38. A hinge as defined in claim 36, wherein said bottom part has a through-going opening through which said arresting member can partially extend.

39. A hinge as defined in claim 36, wherein said arresting member and said first hinge element are arranged between said discs of said second hinge element which supports said arresting member.

40. A hinge as defined in claim 37; and further comprising a foot element having two further discs, said discs of said second hinge element being arranged between said further discs of said foot element.

41. A hinge as defined in claim 1, wherein said arresting member is arranged so that when said second arresting formation of said arresting member engages with said first arresting formations of said first hinge element in condition of loading the latter, said arresting member is subjected to pulling action.

* * * * *